US006029823A

United States Patent [19]

Young et al.

[11] Patent Number: 6,029,823

[45] Date of Patent: Feb. 29, 2000

[54] RECESSED VIBRATOR FOR AN ELLIPTICAL MOTION SCREEN SEPARATOR

[76] Inventors: Grant A. Young; Thomas R. Young, both of 6324 S. 69th E. Pl., Tulsa, Okla. 74133

[21] Appl. No.: 09/189,674

[22] Filed: Nov. 11, 1998

[51] Int. Cl.[7] ..... B07B 1/42; B07B 1/49

[52] U.S. Cl. ..... 209/365.4; 209/405; 209/409; 209/366; 209/325; 209/365.1

[58] Field of Search ..... 209/326, 366, 209/325, 405, 409, 408, 365.1, 365.4, 364

[56] References Cited

U.S. PATENT DOCUMENTS

| | | | |
|---|---|---|---|
| 4,224,146 | 9/1980 | Kent et al. | 209/325 |
| 4,581,132 | 4/1986 | Fritz et al. | 209/405 |
| 4,795,552 | 1/1989 | Yun et al. | 209/319 |
| 5,037,535 | 8/1991 | Bruderlein | 209/326 |
| 5,143,223 | 9/1992 | Herren | 209/405 |
| 5,265,730 | 11/1993 | Norris et al. | 209/326 |
| 5,683,580 | 11/1997 | Young | 210/385 |
| 5,921,401 | 7/1999 | Johnston | 209/315 |

FOREIGN PATENT DOCUMENTS

| | | | |
|---|---|---|---|
| 1256814 | 9/1986 | U.S.S.R. | 209/326 |

*Primary Examiner*—Donald P. Walsh
*Assistant Examiner*—Daniel K Schlak
*Attorney, Agent, or Firm*—Frank J. Catalano

[57] ABSTRACT

A structural mount for a vibrator of a screen separator is provided in which the vibrator mounting plate is secured at an angle directly to the basket side wall structure or to a load bearing structure which is parallel and fixed to the basket side wall structure. In a preferred embodiment of the invention, an opening or pocket is provided in the basket side wall to accommodate protrusion of the inward end of the vibrator into or even through the basket side wall. Access to and removal of the cap from the inward end of the vibrator is accomplished in the former case from the inside of the basket and in the latter case from the outside of the basket. The basket side wall reinforcing structure preferably includes a Y-shaped yoke with the mounting plate being fixed proximate the Y-connection point. Transverse reinforcing members of the basket have their ends fixed to the extremities of the Y-shaped yoke. Thus a modest reinforcement of the basket side wall structure to accommodate reduced displacement of the vibrator from the basket side wall results in a significant reduction in the overall structural requirements of the separator basket.

11 Claims, 3 Drawing Sheets

RECESSED VIBRATOR FOR AN ELLIPTICAL MOTION SCREEN SEPARATOR

BACKGROUND OF THE INVENTION

This invention relates generally to screen separators and more particularly concerns the structural mounts used to fix the vibrators to the basket of the screen separator.

My U.S. Pat. No. 5,683,580, which was directed to the use of non-uniform forward elliptical motion in a screen separator, summarized the use of circular, linear, unidirectional elliptical and multidirectional elliptical motion in the screen separators of the prior art. As explained in the '580 patent, the pattern of motion of a screen separator is a function of alpha, beta and epsilon angles of the vibrator shafts and the rho distance of the vibrator shafts from the center of vibratory mass of the screen separator. The structural configuration in mounting the vibrators to the basket of the screen separator does not change the motion pattern established by the above angles and distance.

A balanced or unidirectional elliptical motion screen separator is described in U.S. Pat. No. 5,265,730. A typical structural mounting configuration usable for the vibrators of a screen separator of any pattern of motion is shown in considerable detail in the '730 patent. As shown in the '730 patent, for field application separators, vibrators are normally mounted on a plate which is fixed to a tube which extends outwardly perpendicularly from the side wall of the basket of the screen separator. In some research applications the tube is replaced by a wedge block and the mounting plate fixed to the block. In either case, the vibrators are displaced outwardly from the basket side wall by a significant distance. Depending on the type of motion desired, the selected angular position of the vibrators can greatly increase their displacement from the basket side wall.

Vibrator displacement from the basket side wall induces destructive moments into the basket assembly. As a result, a heavy vibrator mounting and basket reinforcing structure are necessary which in turn decrease the efficiency and increase the cost of the separator. The greater the basket weight, the higher the vibrator settings must be and, perhaps, a larger and more costly vibrator may even be required. In addition to the induced moments problem, vibrator displacement simply results in a wider separator. This is most undesirable, especially in restricted space applications such as on an offshore rig.

It is, therefore, an object of this invention to provide an improved structural mount for a vibrator of a screen separator. Another object of this invention is to provide a structural mount for a vibrator of a screen separator which minimizes the displacement of the vibrator from the separator basket side wall. A further object of this invention is to provide a structural mount for a vibrator of a screen separator which minimizes the induced moments on the separator basket. It is also an object of this invention to provide a structural mount for a vibrator of a screen separator which is lighter than known mounts. Yet another object of this invention is to provide a structural mount for a vibrator of a screen separator which permits use of a lighter basket reinforcing structure than known mounts. An additional object of this invention is to provide a structural mount for a vibrator of a screen separator which permits use of lower vibrator settings and perhaps smaller vibrators than known mounts. And it is an object of this invention to provide a structural mount for a vibrator of a screen separator which minimizes the width of the separator.

SUMMARY OF THE INVENTION

In accordance with the invention, a structural mount for a vibrator of a screen separator is provided in which the vibrator mounting plate is secured at an angle directly to the basket side wall structure or to a load bearing structure which is parallel and fixed to the basket side wall structure. In a preferred embodiment of the invention, a pocket is provided in the basket side wall to accommodate protrusion of the inward end of the vibrator into or even through the basket side wall. Access to and removal of the cap from the inward end of the vibrator is accomplished in the former case from the inside of the basket and in the latter case from the outside of the basket.

The basket side wall structure or load structure includes a Y-shaped yoke with the mounting plate being fixed proximate the Y-connection point. Transverse reinforcing members of the basket have their ends fixed to the extremities of the Y-shaped yoke. Thus a modest reinforcement of the basket side wall structure to accommodate reduced displacement of the vibrator from the basket side wall results in a significant reduction in the overall structural requirements of the separator basket.

BRIEF DESCRIPTION OF THE DRAWINGS

Other objects and advantages of the invention will become apparent upon reading the following details description and upon reference to the drawings in which.

While the invention will be described in connection with preferred embodiments, it will be understood that it is not intended to limit the invention to those embodiments. On the contrary, it is intended to cover all alternatives, modifications and equivalents as may be included within the spirit and scope of the invention as defined by the appended claims.

DETAILED DESCRIPTION OF THE INVENTION

Figure 1:
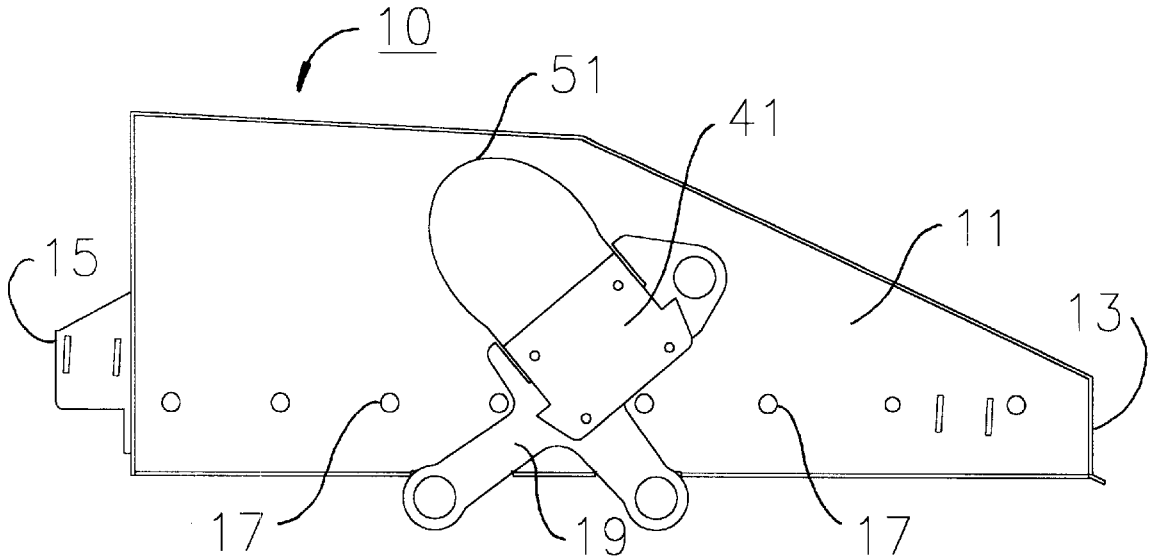
FIG. 1 is a side elevation view of an open sidewall embodiment of the vibrator screen separator basket.

Turning first to FIG. 1, a screen separator basket 10 has mirrored sidewalls 11 connected by a front wall 13 and a back wall 15. As shown, a plurality of apertures 17 are provided across the lower portions of each of the sidewalls 11 to accommodate the screen tensioning assembly (not shown). Each of the sidewalls 11 has fixed thereto a reinforcing member such as the Y-shaped yoke 19. The yoke 19 is shown more clearly in FIG. 2 and preferably has apertures 21 and 23 in two of its extremities 25 and 27, respectively, which are aligned on a horizontal axis 29, and a third aperture 31 in the remaining extremity 33 which is above the horizontal axis 29. Preferably, the third aperture 31 will be aligned on an axis 35 extending from the first aperture 21 at an angle 37 such that the aperture axis 35 is perpendicular to the axis 39 of its vibrator which is selected to provide the desired elliptical motion.

Figure 2:
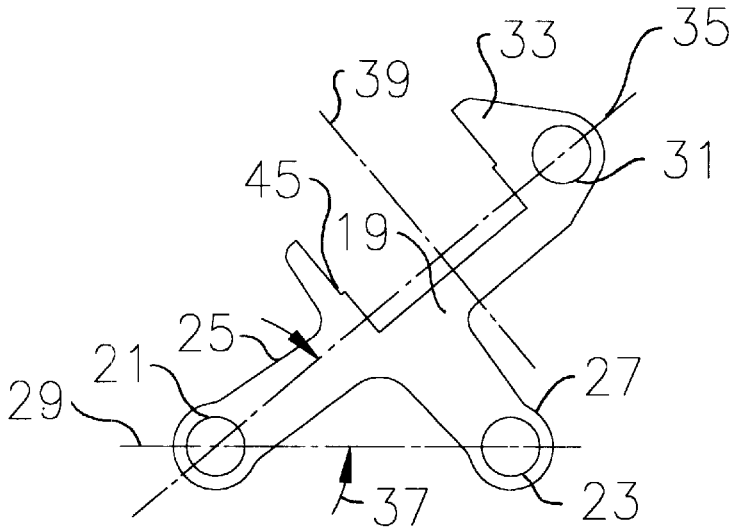
FIG. 2 is a side elevation view of a preferred embodiment of the reinforcing yoke of the basket of FIG. 1.
Figure 3:
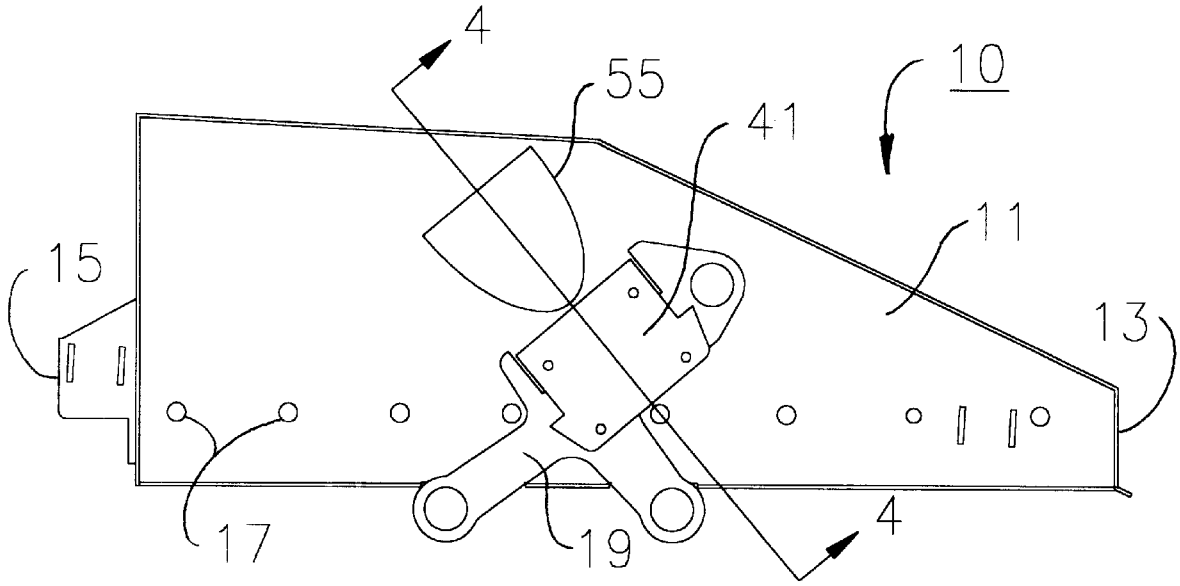
FIG. 3 is a side elevation view of a pocket sidewall embodiment of the vibrator screen separator basket.

As shown in FIGS. 1 and 3, with the yoke 19 having been fixed, preferably by welding, to the basket sidewall 11, the vibrator mounting plate 41 can be welded to the reinforced sidewall 11. Looking at FIG. 4, the side plate 41 is welded to the sidewall 11 and to the yoke 19 at another angle 43 which, in combination with the first angle 37, determines the pattern of elliptical motion of the separator. As is best seen in FIG. 2, the yoke 19 is provided with a cut-out 45 to accommodate welding the mounting plate 41 to the sidewall 11.

Figure 4:
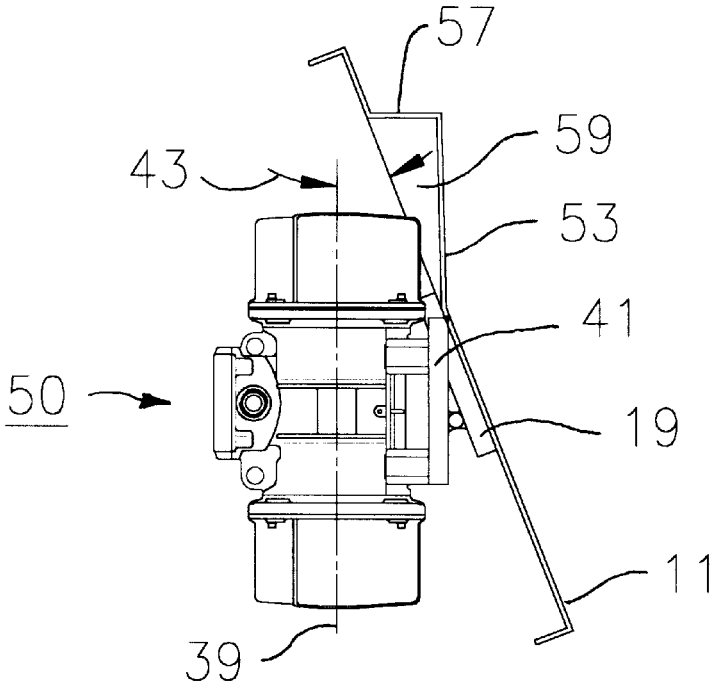
FIG. 4 is a cross-sectional view taken along the line 4—4 of FIG. 3.

Looking at FIG. 4, depending on the angle 43 of the vibrator axis 39 to the sidewall 11, the inboard end of the vibrator 50 may be required to penetrate the sidewall 11. As shown in FIG. 1, an opening may be cut in the sidewall 11 to accommodate the extension of the inboard end of the vibrator 50 into the basket 10. The approximately three-quarter elliptical opening 51 shown is suitable to accommodate various angular positions of the vibrator 50, though other opening shapes may be employed. As shown in FIGS. 3 and 4, an angle cut piece of pipe 53 can be welded over a matching cut-out 55 in the sidewall 11 with an end plate welded to the pipe 53 and the sidewall 11 to completely seal a pocket 59 in the sidewall into which the inboard end of the vibrator 50 may extend.

Figure 5:
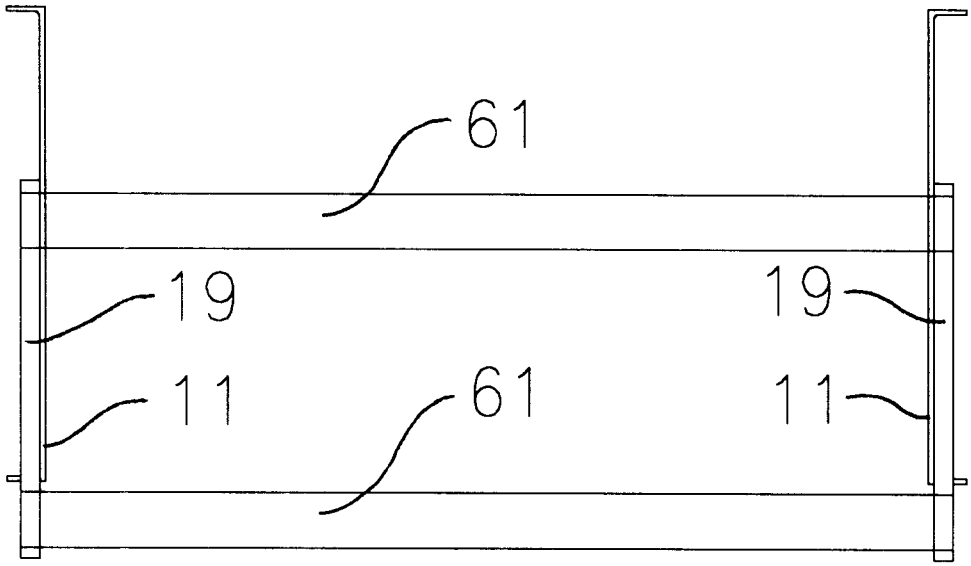
FIG. 5 is a front elevation view of the reinforcing structure of the vibrator screen separator basket.

As shown in FIG. 5, the mirrored yokes 19 are welded to the outside faces of the basket sidewalls 11 and reinforcing members, such as the tubular members 61 are welded in the mirrored apertures 21, 23 and 31 of the yokes 19. The reinforcing plates 19 and tubes 61 accommodate the mounting of the vibrator plates 41 to the basket sidewalls 11 directly, thus reducing undesirable moments in the separator and enabling the use of an overall lighter separator with smaller vibrators or, at least, with vibrators operating under more optimal conditions.

It has been found that a Y-shaped yoke of one inch steel plate used in association with a vibrator mounting plate made of one inch steel plate and reinforcing tubes 61 of two and one-half inch outer diameter by one-quarter inch thick pipe is suitable for most applications. However, depending on the particular application and the strength requirements imposed, the configuration and dimensions of the reinforcing structure will be changed accordingly. Such modifications are within the knowledge of those skilled in the art. What is essential is that the vibrator mounting plates 41 be mounted directly to the basket sidewalls 11 and to the reinforcing members 19 which are part of the basket sidewalls 11 rather than having the mounting plates 19 extended laterally away from the sidewalls 11.

Thus, it is apparent that there has been provided, in accordance with the invention, a recessed vibrator for an elliptical motion screen separator that fully satisfies the objects, aims and advantages set forth above. While the invention has been described in conjunction with specific embodiments thereof, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. For reinforcing a basket of an elliptical motion screen separator having two vibrators mounted on opposite sides of the separator basket at angles in relation to the basket selected to provide a desired pattern of motion of the basket, the basket having spaced apart side walls, a structure comprising:

a pair of flat reinforcing plates fixed in laminar arrangement to each of the basket side walls;

a plurality of parallel elongate reinforcing members extending transversely between and fixed to the reinforced sidewalls; and a pair of flat mounting plates, one fixed to an outside face of each of the reinforced basket side walls, at plate angles selected to support the vibrators mounted thereon at the vibrator angles selected to provide the desired pattern of motion.

2. A structure according to claim 1, each reinforcing plate having a plurality of apertures therethrough with said apertures in mirrored alignment and said reinforcing members being tubular and fixed at their ends in mirrored ones of said apertures.

3. A structure according to claim 2, said apertures and said tubular members being of circular cross-section.

4. A structure according to claim 3, said reinforcing plates having a Y-shaped configuration with one said aperture in each extremity of said Y-shaped plates.

5. A structure according to claim 4, two of said apertures of each of said reinforcing plates being aligned in a common horizontal plane.

6. A structure according to claim 5, each of said tubular members connecting said common horizontal apertures extending below a bottom of the basket.

7. A structure according to claim 5, a third aperture of each of said reinforcing plates being aligned on an axis extending at an angle from one of said common horizontal apertures above said horizontal plane.

8. A structure according to claim 7, said angle being approximately perpendicular to the desired axis of the vibrator to be mounted on said mounting plate.

9. A structure according to claim 1, each of said reinforcing plates having a cut-out therein to facilitate fixing one of said mounting plates to its respective one of the basket side walls and one of said reinforcing plates.

10. A structure according to claim 1 further comprising an opening through each of said basket side walls for receiving an inboard end of its respective vibrator therein when the vibrator is mounted on its respective mounting plate.

11. A structure according to claim 10 further comprising an enclosure covering each of said openings on an inboard side thereof and defining a pocket for receiving its respective vibrator inboard end therein.

* * * * *